United States Patent [19]

Thorsell

[11] 4,394,808

[45] Jul. 26, 1983

[54] FASTENER FOR ATTACHING PANEL TO STUD

[75] Inventor: Stanley E. Thorsell, Edmonton, Canada

[73] Assignees: Robert S. Agar, Inc.; Thorsell Holdings Ltd.; Mudlake Holdings Ltd., all of Canada

[21] Appl. No.: 210,179

[22] Filed: Nov. 25, 1980

[51] Int. Cl.[3] ..... E04H 1/00; E04B 5/52

[52] U.S. Cl. ..... 52/483; 52/511

[58] Field of Search ..... 52/481, 483, 489, 346, 52/357, 359, 511

[56] References Cited

U.S. PATENT DOCUMENTS

| | | | |
|---|---|---|---|
| 3,445,975 | 5/1969 | Nelsson | 52/359 |
| 4,128,979 | 12/1978 | Price | 52/241 |
| 4,245,448 | 1/1981 | Agar | 52/489 |

*Primary Examiner*—James L. Ridgill, Jr.
*Attorney, Agent, or Firm*—Max L. Wymore

[57] ABSTRACT

The fastener comprises the combination of a gang nail plate and a clip. The plate is driven into the gypsum board panel to attach itself thereto. The clip connects with the plate and extends beyond its side edge. A screw or nail is driven through an aperture in the protruding end of the clip, to secure the panel to a supporting stud.

The gang nail plate is known. It consists of a plate having tangs protruding from the inner face thereof and a slot-forming transverse member protruding from the outer face. The clip is a flat, rectangular, spring steel plate formed with an upwardly inclined inner end, a flat outer end, and a downwardly inclined central portion. The clip's inner end is wedged into the slot to tightly connect panel, plate and clip.

1 Claim, 2 Drawing Figures

FASTENER FOR ATTACHING PANEL TO STUD

FIELD OF THE INVENTION

This invention relates to a fastener for securing a gypsum board panel to a wooden or metal stud in connection with the erection of a partition wall.

BACKGROUND OF THE INVENTION

Heretofore gypsum board panels have usually been attached to vertical studs using either:

(a) nails or screws driven through the panel at its marginal edge and embedded in the stud; or (b) concealed fasteners which each have tangs embedded in the side edge face of the panel and which further have an apertured lug or ear which extends beyond the panel edge and through which a nail or screw is driven to secure the fastener to the stud (an example is shown in U.S. Pat. No. 4,127,975).

These two existing fastening means are characterized by certain disadvantages. In case (a), involving nails or screws alone, it is usually necessary to conceal them by taping them or covering them with a batten. This is costly to do. In case (b), the side edge material of the panel tends to give way and the panel can then twist free from the fastener tangs. Also, these concealed fasteners do not press the panel firmly against the stud and there is therefore some 'sponginess' in the wall.

There is therefore a need for a concealed fastener which provides a secure and stable connection between the panel and stud and which further firmly draws the panel against the stud.

At this point, it is useful to note U.S. Pat. No. 4,128,979, which relates to a suspension assembly for hanging a gypsum board panel from a horizontal channel. This patent discloses a gang nail plate, which is utilized as a component in the present invention. As shown, the gang nail plate has integral tangs extending outwardly from its inner face—these tangs are driven into the panel to firmly affix the plate thereto. Transverse lines of weakness are provided in the plate to permit its central portion to be drawn outwardly, thereby causing the tangs to assume an angular position whereby they tightly clinch the core material. The plate further has a transverse slot member protruding outwardly from its outer face—this transverse slot member provides a clip-receiving slot; the present invention involves use of this slot, as described below.

SUMMARY OF THE INVENTION

With this background in mind, the present invention provides a concealed-type fastener for affixing a gypsum board panel to a stud. The fastener is characterized by providing a secure, stable connection which draws the panel in tightly against the stud.

The invention involves attaching one or more of the previously described gang nail plates adjacent the side edge of a gypsum board panel, with the plate slot being arranged in a generally horizontal direction. Each plate is combined with a clip of novel configuration to provide a novel combination which achieves an advantageous result. More particularly, the clip is formed of stiff, resilient material (for example, of spring steel). It may be formed of flat rectangular stock and is bent so that, when in engagement with the plate, it has a first end portion which lies generally flat against the panel margin and extends beyond the latter's side edge. This first end portion has an aperture through which means, for example a nail or screw, may extend. The nail or screw is driven into the stud to firmly affix the clip thereto. A second end portion of the clip is upwardly, angularly disposed so that, having been inserted into the slot, it wedges tightly against the transverse slot member. A downwardly directed central portion connects the two end portions of the clip.

The gang nail plate is characterized by providing a particularly powerful grip on the back of the panel. Wedging of the clip against the transverse slot member tightly secures the clip to the plate. And the peak-like configuration of the clip and the wedging of it tend to cause the first end portion to press tightly against the panel. The end result is a firm connection between panel and stud which also functions to draw the panel tight against the stud. Sponginess of the product wall is thus reduced.

Broadly stated, the invention comprises, in combination, a gypsum board panel having attached thereto adjacent a side edge thereof at least one gang nail plate, said plate having tangs extending from the inner face thereof and being embedded in the panel, said plate further having a transverse slot member extending outwardly from the outer face thereof, said slot member forming a clip-receiving slot extending in a generally horizontal direction; a stiff, resilient clip, said clip comprising a first end portion which lies generally flat against the panel and extends beyond the latter's side edge, a second end portion which is upwardly and angularly disposed away from the panel, the end of the said second end portion being wedged in the slot, and a central portion extending upwardly and angularly from the panel and connecting said end portions, said second end portion and central portion combining to provide a V-shaped configuration with the apex directed away from the panel said first end portion forming an aperture in the section extending beyond the panel side edge; a support member; and means extending through the aperture into the support member to tie the clip and support member together; whereby the clip wedges against the transverse slot member and thus the plate and clip remain tight together and provide, in conjunction with the tie means, a firm connection between the panel and support member.

DESCRIPTION OF THE PREFERRED EMBODIMENT

Figure 1:
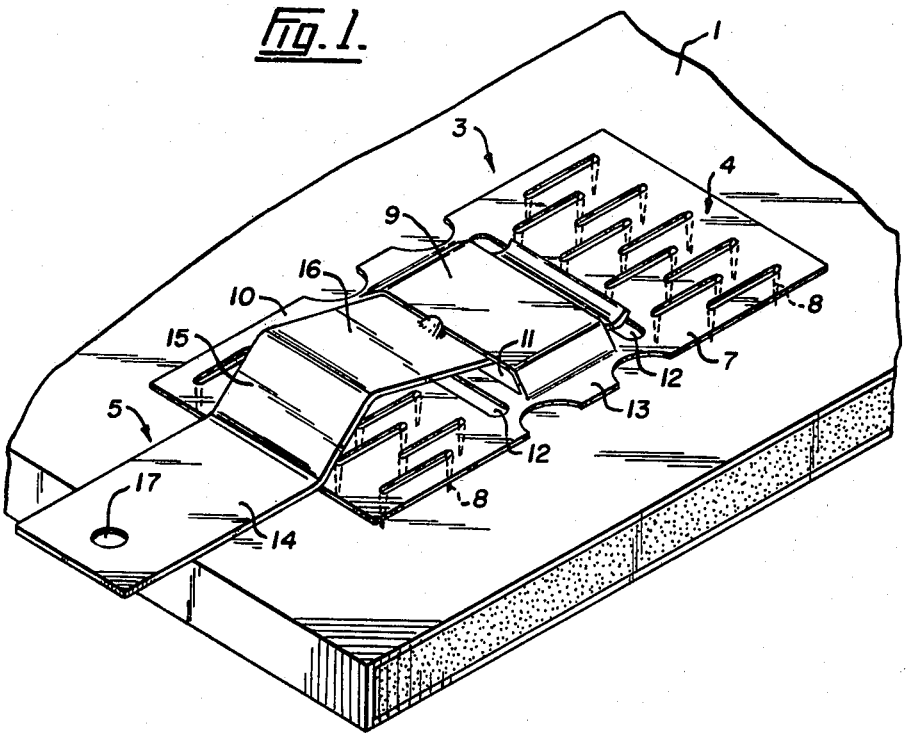
FIG. 1 is a perspective view of the fastener attached to a gypsum board panel.

With reference to the drawing, there is shown a gypsum board panel 1 secured to a stud 2 by a fastener 3. The fastener 3 comprises a gang nail plate 4, a clip 5 and a screw 6.

Figure 2:
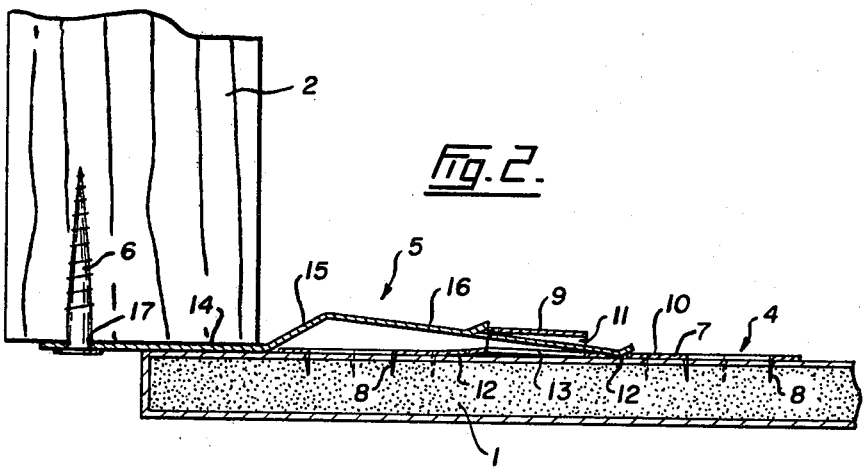
FIG. 2 is a side sectional view of the fastener connecting a stud and panel.

The gang nail plate 4 comprises a plate 7 having tangs 8 extending from the inner face thereof. A transverse slot member 9 protrudes outwardly from the clip's outer face 10 and forms a slot 11. Transverse lines of weakness are provided in the plate 7 by cut-outs 12, so that the plate central portion 13 can bend as shown in FIG. 2.

The clip 5 has first, second and central portions 14, 16, 15 respectively. The second portion 16 is upwardly inclined; it is wedged tightly into the slot 11 when assembled. The central portion 15 is downwardly directed and connects the end portions 14, 16. The first portion 14, presses tightly against the panel 1 and extends beyond the panel edge. A screw 6 extends through a hole 17, formed in the first portion 14, into the support member or stud 2. The screw 6 provides means tieing together the clip 5 and stud 2.

When assembled as shown, the fastener 3 tightly connects the panel 1 to the stud 2.

The embodiments of the invention in which an exclusive property or privilege is claimed are defined as follows:

1. In combination:

a gypsum board panel having attached thereto adjacent a side edge thereof at least one gang nail plate, said plate having tangs extending from the inner face thereof and being embedded in the panel, said plate further having a transverse slot member extending outwardly from the outer face thereof, said slot member forming a clip-receiving slot extending in a generally horizontal direction;

a stiff, resilient clip, said clip comprising a first end portion which lies generally flat against the panel and extends beyond the latter's side edge.

a second end portion which is upwardly and angularly disposed away from the panel, the end of said second end portion being wedged in the slot, and a central portion extending upwardly and angularly from the panel and connecting said end portions, said second end portion and central portion combining to provide a V-shaped configuration with the apex directed away from the panel;

said first end portion forming an aperture in the section extending beyond the panel side edge;

a support member;

and means extending through the aperture into the support member to tie the clip and support member together;

whereby the clip wedges against the transverse slot member and thus the plate and clip remain tight together and provide, in conjunction with the tie means, a firm connection between the panel and support member.

* * * * *